US008178805B2

(12) United States Patent
Larson et al.

(10) Patent No.: US 8,178,805 B2
(45) Date of Patent: May 15, 2012

(54) APPLIANCE CONTROL KNOB PROVIDING ILLUMINATED SETTING INDICATION

(75) Inventors: Eric K. Larson, Cumberland, RI (US); Juan J. Barrena, Johnston, RI (US); James J. MacDonald, Jr., Dedham, MA (US); Mark A. Romo, Paw Paw, MI (US); Andy W. Tucker, Pawtucket, RI (US)

(73) Assignee: Illinois Tool Works Inc., Glenview, IL (US)

( * ) Notice: Subject to any disclaimer, the term of this patent is extended or adjusted under 35 U.S.C. 154(b) by 318 days.

(21) Appl. No.: 12/686,736

(22) Filed: Jan. 13, 2010

(65) Prior Publication Data

US 2010/0181174 A1 Jul. 22, 2010

Related U.S. Application Data

(60) Provisional application No. 61/145,634, filed on Jan. 19, 2009.

(51) Int. Cl.
*H01H 9/00* (2006.01)

(52) U.S. Cl. ..... 200/316

(58) Field of Classification Search ..... 200/37 R, 200/336, 11 R, 11 B, 11 C, 11 G, 308–317; 439/488–490; 362/551, 29, 30
See application file for complete search history.

(56) References Cited

U.S. PATENT DOCUMENTS 6,667,446 B1 * 12/2003 Schuberth et al. ..... 200/4
7,205,495 B2 * 4/2007 Mazur ..... 200/316
7,780,325 B2 * 8/2010 Collomb et al. ..... 362/551

* cited by examiner

*Primary Examiner* — Edwin A. Leon
(74) *Attorney, Agent, or Firm* — Mark W. Croll; Paul F. Donovan

(57) ABSTRACT

A shaft of a rotary switch, for example, useful as a control for an appliance, such as a washing machine, incorporates an LED at the end of the shaft and projecting light laterally from the shaft to provide an indication of the rotary position of the corresponding knob with respect to printed indicia on a console. The LED may be powered by slip rings incorporated into the rotary switch and communicating directly with line power as controlled by the limiting resistor and the shaft may include a controlled breakage feature providing LED conductors that are recessed within the shaft in the event of shaft breakage to reduce the chance of operator contact with line voltage.

16 Claims, 4 Drawing Sheets

APPLIANCE CONTROL KNOB PROVIDING ILLUMINATED SETTING INDICATION

CROSS-REFERENCED TO RELATED APPLICATIONS

This application claims the benefit of U.S. Provisional Application Ser. No. 61/145,634 filed on Jan. 19, 2009 and hereby incorporated by reference.

BACKGROUND OF THE INVENTION

It is known to provide controls for common household appliances that provide an illuminated indication of their setting, for example, using LEDs, backlit LCDs, or plasma type displays. Such illuminated controls are aesthetically attractive, allow the appliance to be easily used in low light areas, and provide an indication of their setting visible at a distance.

Present electrical and electromechanical controls for washing machines and the like provide an operator knob having a pointer, for example an embossed line or arrow, that may be rotated into alignment with preprinted indicia indicating the control's setting. Often the indicia are printed on an opaque, enameled metal sheet. A rotational control of this type is both familiar and provides an intuitive representation of the various machine cycles, both during setting of the machine and during its execution of cycle stages when the knob may rotate as each stage is completed. Nevertheless, operation of this type of rotation control in lowlight settings can be difficult.

SUMMARY OF THE INVENTION

The present invention provides a simple and energy efficient method of providing setting illumination when using standard electromechanical or electrical rotating knob controls such as found in a washing machine. In one embodiment of the invention, a light emitting diode is placed into the end of an operator shaft receiving the control knob. Sliding contacts provide power to the LED from within the housing. By moving the LED closer to the knob and allowing it to be preferentially aligned with the pointer on the knob, substantially improved light-efficiency can be obtained with a rotating type control.

Specifically, the present invention provides a control for an appliance or the like having an electrical switch with contacts for controlling the appliance. A shaft communicates at a proximal end with the electrical switch and actuates the electrical switch with rotation of the shaft about an axis. The shaft has a light passageway at a distal end, and an LED positioned within the shaft at the distal end is aligned with the light passageway to project a beam of light substantially perpendicular to the axis therefrom.

It is thus a feature of at least one embodiment of the invention to provide improved illumination of the positioning of a rotary operator of an electric switch by permitting a more direct illumination path from a distally located LED.

The control may further include second contacts communicating with the LED to conduct electricity to the LED with rotation of the shaft.

It is thus a feature of at least one embodiment of the invention to provide improved illumination in a free rotating control.

The electrical switch may include terminals receiving line voltage and the second contacts may communicate with corresponding contacts connected to the line voltage.

It is thus a feature of at least one embodiment of the invention to provide a control suitable for use in standard appliances operating at 110-120 VAC.

The control may include at least one electrical resistor providing a voltage dropping of the line voltage to control the current passing through the LED.

It is thus a feature of at least one embodiment of the invention to provide simple, integrated power conditioning for powering the LED suitable for an appliance control.

The LED may communicate with the second contacts by means of electrical conductors preferentially separating into distal and proximal portions at a separation plane crossing the axis and displaced with respect to a fracture plane of the shaft so that in the event of fracturing of the shaft the distal portion remains recessed within the shaft beneath the fracture plane.

It is thus a feature of at least one embodiment of the invention to permit direct connection of the LED to line voltage while reducing the chance that the user will be exposed to line voltage directly in the event of damage of the control.

The distal and proximal portions of the electrical conductors may be joined by a pin and socket at the separation plane.

It is thus a feature of at least one embodiment of the invention to provide a simple mechanism for controlling a point of separation of the electrical conductors.

Alternatively, the distal and proximal portions of the electrical conductors may be joined by a spring and abutting contact at the separation plane. The spring may communicate between the abutting contact portion and a trace on a printed circuit board providing a contact carrier.

It is thus a feature of at least one embodiment of the invention to provide a controlled separation of the conductors and a simple method of communicating between the LED and a printed circuit board supporting rotating electrical contacts.

The fracture plane of the shaft may be defined by a stress-concentrating feature in the shaft.

It is thus a feature of at least one embodiment of the invention to control a fracture point of the shaft to better shield the user from possibly hazardous voltages.

The control may further include a knob engaging the distal end of the shaft in the knob and having a second light passageway aligned with the light passageway of the distal end of the shaft to communicate light from the LED to an edge of the knob to illuminate indicia indicating cycle information.

It is thus a feature of at least one embodiment of the invention to provide a control that may work with a variety of different interchangeable knobs for different appliance models.

The second light passageway may be a lens.

It is thus a feature of at least one embodiment of the invention to permit further diffusion, focusing or collimation of the light from the LED by the knob such as may be changed by different knobs for different applications.

The second light passageway of the knob may light at the panel holding the indicia.

It is thus a feature of at least one embodiment of the invention to permit a direction of the light by the knob to focus the light on printed indicia on the panel.

Other features and advantages of the invention will become apparent to those skilled in the art upon review of the following detailed description, claims and drawings in which like numerals are used to designate like features.

DETAILED DESCRIPTION OF THE INVENTION

Figure 1:
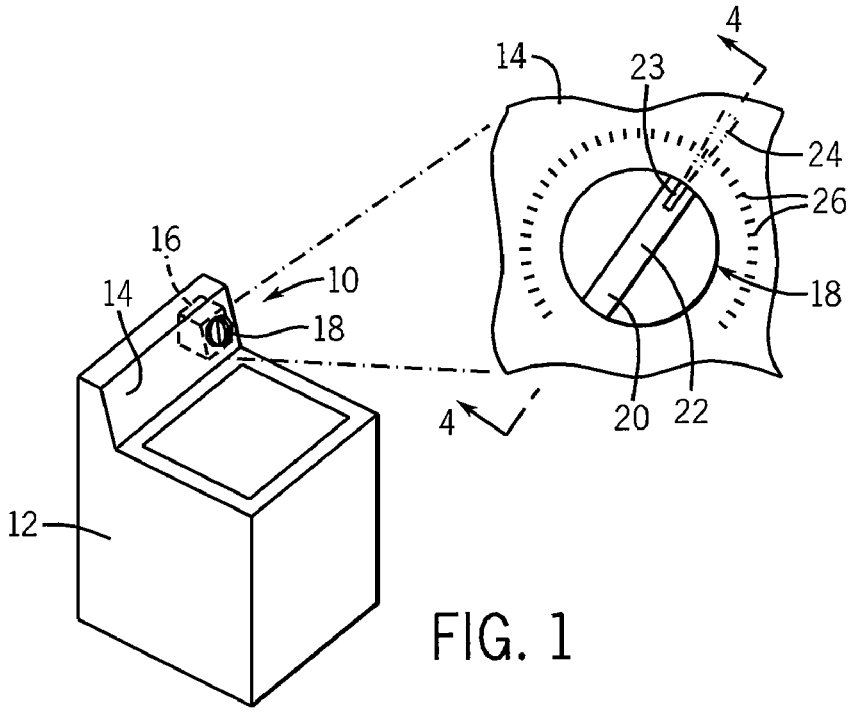
FIG. 1 is a perspective view of a washing machine showing an enlarged detail of a control knob providing illumination of its environment.

Referring now to FIG. 1, a washing machine 10 suitable for use with the present invention includes a housing 12, typically of enameled steel, having a front facing console 14 supporting a control 16 such as a cycle timer or the like. The washing machine 10 may include an internal spin basket, motor, and water-handling electromechanical valves (not shown) as understood in the art.

A control 16, for example a cycle timer, attaches in part behind the console 14 and provides a shaft 34 (not shown in FIG. 1) which passes through the console 14 and attaches to a knob 18, the latter which may be rotated to control the cycling of the washing machine 10 and which may also rotate during operation to indicate a current cycle stage.

The knob 18 may include a finger grip 20 that may be grasped by a user to rotate the knob 18 about a center axis 22. A transparent or translucent lens 23 may be exposed at one end of the finger grip 20 and may be internally illuminated (as will be described) both to provide a visual indication of the pointer-end of the knob 18 and to provide an illuminating beam 24 striking printed indicia 26 printed on the face of the console 14, for example, such as describe the current washing cycle or, when used in other control applications, describe water temperature or the like.

Figure 2:
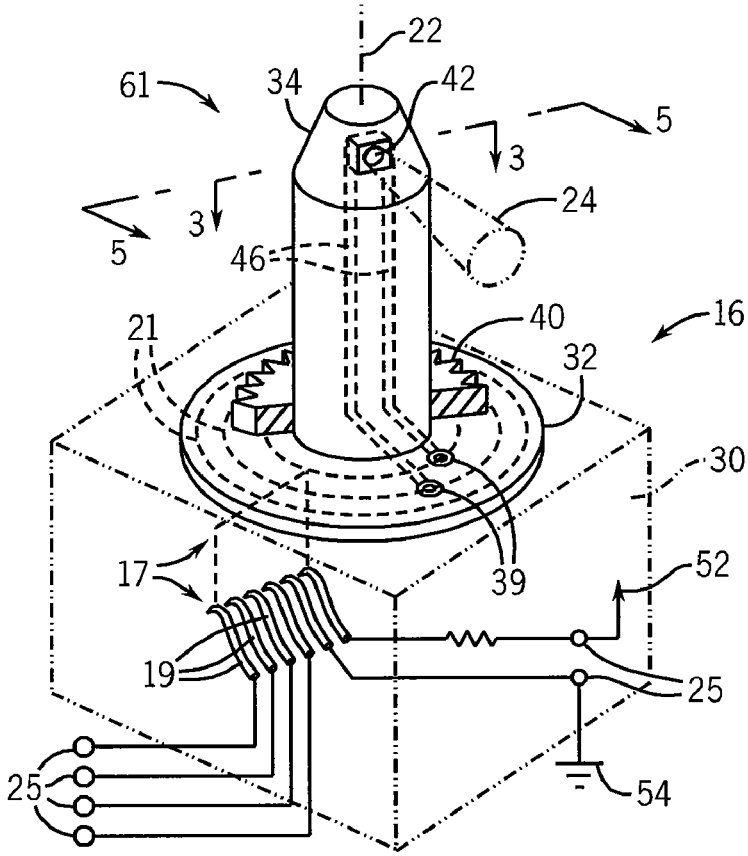
FIG. 2 is an exploded perspective view of a control shaft and contact system, the control shaft receiving the control knob of FIG. 1 and having an incorporated LED.

Referring now to FIG. 2, the control 16 includes a housing 30 sitting behind the console 14 and holding contacts 17 of the control 16. In one embodiment, the contacts 17 may include a set of cantilevered flexible metallic fingers 19 contacting, at the cantilevered end, the under surface of a disk-shaped contact carrier 32 having conductive traces 21 formed thereon, the latter which interconnect with the fingers 19 as the contact carrier 32 is rotated about axis 22. The contact carrier 32 may, for example, be a disc of printed circuit board material having conductive traces 21 formed using standard etching techniques.

At least some of the metallic fingers 19 may connect with a motor, solenoid, or other actuator (not shown) of the washing machine 10 to control the application of line voltage (approximately 115 VAC) to those components to control the same directly or may connect with a microprocessor (not shown) providing similar signals indicating rotation of the contact carrier 32. Optionally, a motor or the like (not shown) may advance the contact carrier 32 during operation of the washing machine 10 in a conventional matter.

More generally, the contact carrier 32 may be rotated manually through the shaft 34 connected to the knob 18. The shaft 34 may have a cylindrical portion 36 extending from a proximal end attached to the contact carrier 32, out of the housing 30 to pass through the console 14 and to be received by the knob 18. The cylindrical portion 36 within the console 14 may further attach to, for example, a gear 40 concentric with the operator shaft 34 (shown in fragment) providing a detent surface interengaging with a spring finger (not shown) providing incremental stable positions of rotation of the shaft 34 corresponding to switch states of the contacts 17.

In one embodiment, the operator shaft 34 may be molded entirely or in part of a transparent or translucent thermoplastic material. Molded or inserted within the distal end of the cylindrical portion 36 of the operator shaft 34 is a light emitting diode 42 positioned to project a light beam 44 generally perpendicular to the axis 22. Alternatively, as shown, in FIG. 3, the LED 42 may be aligned with an opening 59 allowing the light to pass out of this opening 59 without attenuation by plastic material.

The LED 42 may be attached to a lead frame consisting of axial conductors 46 that may pass axially along the axis 22 within the cylindrical portion 36 toward the contact carrier 32 and then bend perpendicularly to the axis 22 to extend along the upper side of the rotational contact carrier 32 to connect with the traces 21 on the lower side of the contact carrier 32 through vias 39. Alternatively, the conductors 46 may be part of a narrow printed circuit board molded to fit into the shaft 34.

Two of the traces 21 on the underside of the contact carrier 32 may be continuous rings concentric about axis 22 and connected through metallic fingers 19, respectively, to a source of line power 52 and ground 54, in series with a current-limiting resistor 56 to provide power to the LED over a range of different rotations of the shaft 34 about axis 22. The traces 48 may alternatively or in addition provide for shunted breaks (not shown) so that at certain relative positions of the contact carrier 32, the LED 42 is not illuminated.

The other traces 21 provide switching functions to control the washing machine 10 and may be continuous or interrupted and interconnected and/or connected alternately to one of power 52 or ground 54 by traces on the upper surface of the contact carrier 32. In this way, power or ground may be applied through selective terminals 25 or those terminals 25 may be shorted together or isolated from each other with rotation of the contact carrier 32.

Figure 3:
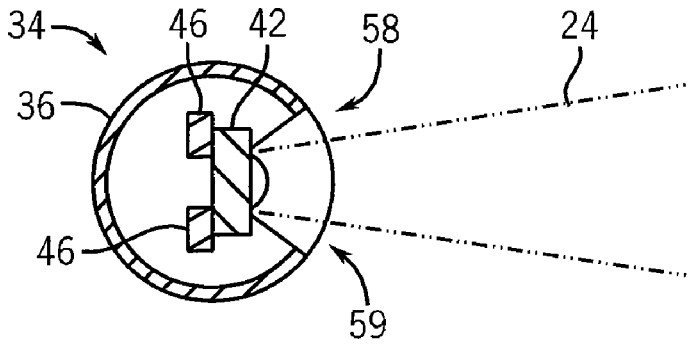
FIG. 3 is a fragmentary cross-section along line 3-3 of FIG. 1 showing alignment of the LED in the operator shaft with a lens in the control knob.

Referring now to FIG. 3, the LED 42 may face a flattened portion 58 on the cylindrical portion 36 to allow light from the LED to pass out of the cylindrical portion 36 with a minimum of internal reflection through opening 59. This flattened portion 58 may further provide a keying controlling the orientation of the knob 18 on the shaft so that the light handling features of the knob 18 are properly aligned with the LED 42.

Figure 4:
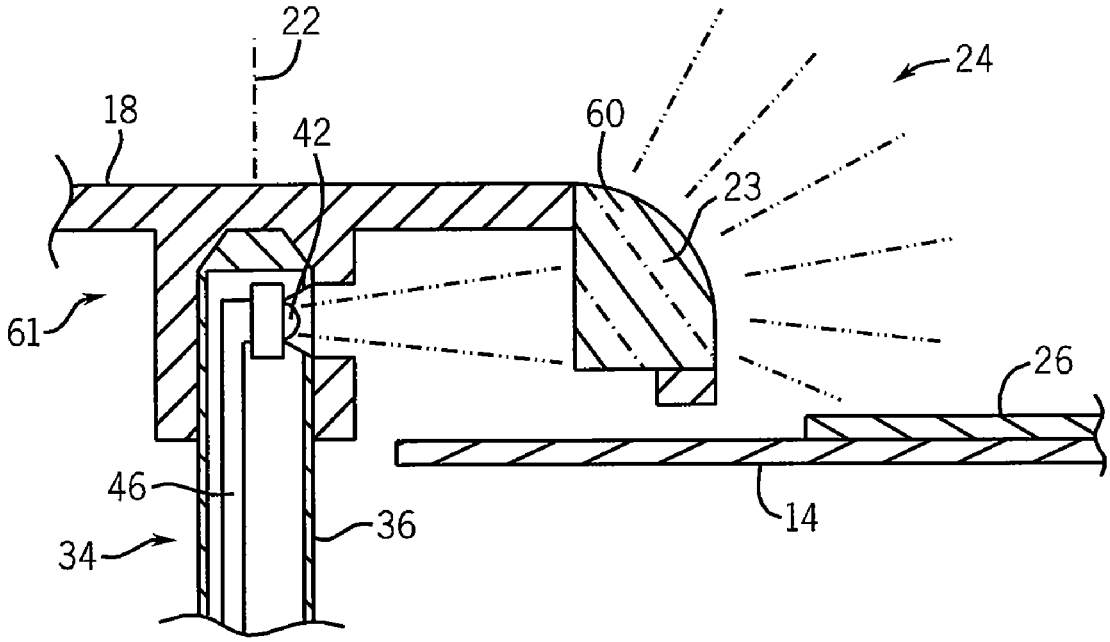
FIG. 4 is a fragmentary cross-section of the operator shaft and control knob taken along line 4-4 of FIG. 1.

Specifically, and referring also to FIG. 4, this light passing out of the cylindrical portion 36 may be received by a corresponding lens 23 within the knob 18. The lens 60 may serve to provide a beam spreading function or a collimation function for the beam and/or may direct the beam downward toward the indicia 26 on the console 14 surrounding the knob 18.

By moving the LED 42 toward a distal end 61 of the shaft 34, a smaller LED may produce a higher intensity beam exiting the knob 18.

Figure 5:
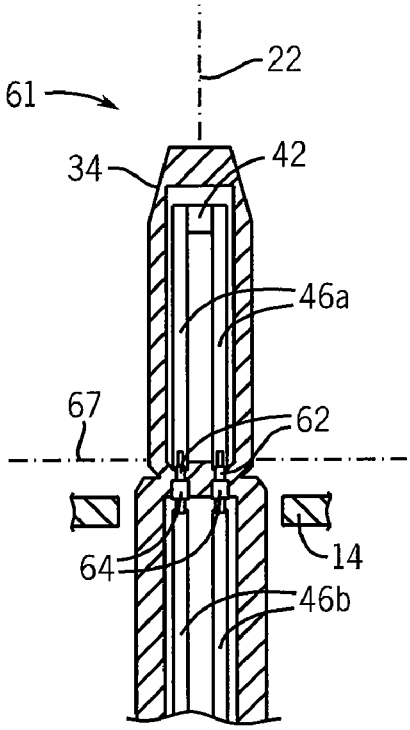
FIG. 5 is an elevation of cross-section taken along lines 5-5 of FIG. 2 showing the joining of internal conductors of the intact shaft by pin and socket connectors defining a separation plane.

Referring now to FIG. 5, as noted, the LED 42 connects directly to line voltage through resistor 56 and therefore, in certain cases of resistor failure and damage of the shaft 34, may expose a user to a live electrical conductor. Accordingly the conductors 46 may be separated into distal conductors 46*a* and proximal conductors 46*b* separated from each other along axis 22 by interengaging pins 62 attached to distal conductors 46*a* and sockets 64 attached to proximal conductors 46*b*. These pins 62 and sockets 64 may be molded into the thermoplastic of the shaft 34 at a feature 66, for example, a notch in the shaft 34 passing circumferentially about the shaft 34 to promote fracture of the shaft 34, in the event of impact, at the feature 66. In this case, the feature 66 defines a fracture plane 67 generally perpendicular to the axis 22.

Figure 6:
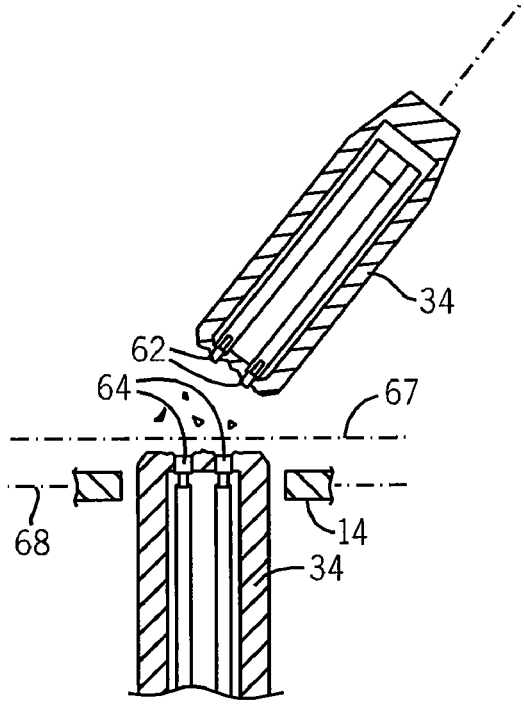
FIG. 6 is a figure similar to that of FIG. 5 showing disconnection of the pin and socket connector when the shaft is broken at a fracture plane.

Referring now to FIG. 6, upon fracture at the fracture plane 67, the pins 62 disengage from the sockets 64 at a separation plane 68 so that the sockets 64 remain recessed beneath thermoplastic of the remaining shaft 34 thus removed from accidental contact to the customer. The fracture plane 67 may be alternatively defined by internally weakened structure of the shaft 34 and/or a location near the hole through the console 14, the edge of which may act as a fulcrum against which the shaft 34 will likely break in the event of a side impact.

Figure 7:
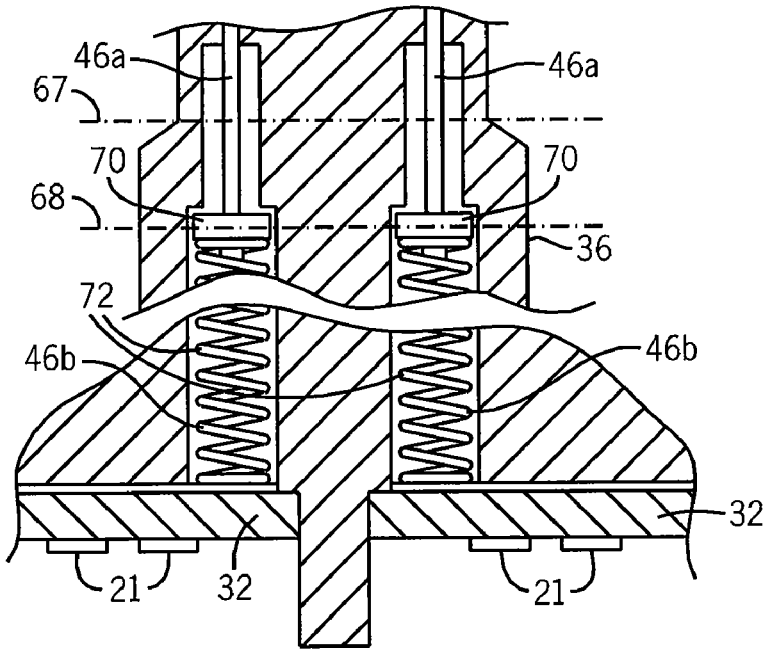
FIG. 7 is a cross-sectional view similar to that of FIG. 5 of an alternative embodiment to the pin and socket connectors of FIGS. 5 and 6 employing contact and spring connectors that provide for separation of the internal conductors of the shaft as well as connection of the LED to a printed circuit board providing a support disk for contacts of the switch.

Alternatively, as shown in FIG. 7, the distal conductors 46*a* may join with the proximal conductors 46*b* at the separation plane 68 at an interface formed between conductor 46*a* and a blunt contact 70 terminating a helical compression spring 72, the latter two forming the entirety of the proximal conductors 46*b*. When the shaft 34 is intact, as depicted, a slight compression of the helical compression springs 72 holds the contacts 70 against the ends of conductors 46*a* which may terminate the ends of the distal conductors 46*a*. This compression, however, once released upon breakage of the shaft 34, is insufficient to expose the springs of conductors 46*b* to the user.

Figure 8:
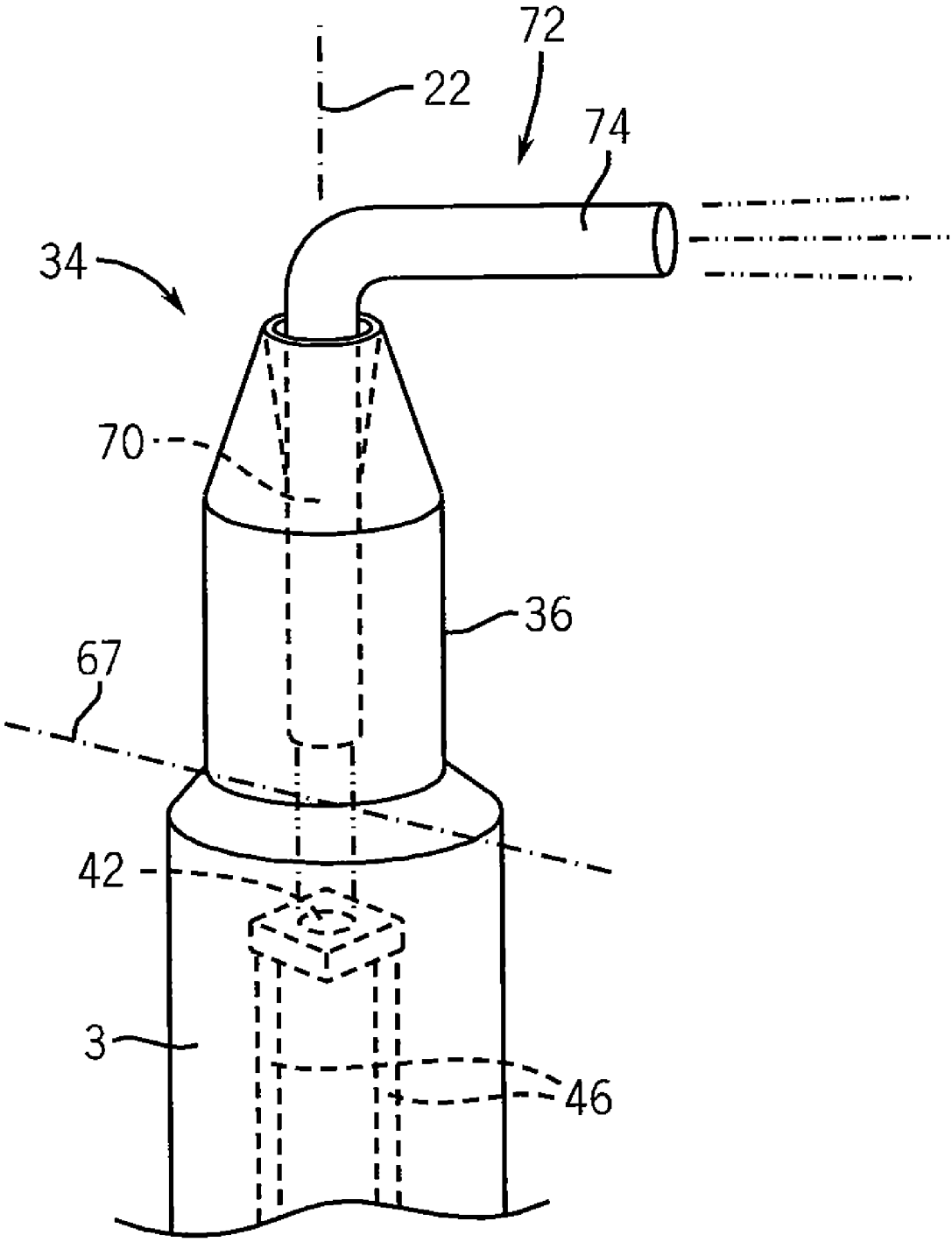
FIG. 8 is a fragmentary figure of the control shaft having the LED displaced below a fracture plane and using a light pipe to conduct light out of the control shaft Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

Referring now to FIG. 8, in an alternative embodiment, the LED 42 may be positioned to face upward with in the shaft 34 to direct light into an axial portion 70 of a light pipe 72. Light pipe 72 may, for example, be a transparent thermoplastic rod conducting light by internal reflection in the manner of a fiber optic. Light conducted from the axial portion 70 may then be directed perpendicular to the axis 22 by a radial portion 74 forming a continuation of the same light pipe 72. Because the LED 42 is embedded in the shaft 34, alignment of the LED 42 with the light pipe 72 is insured for all rotary positions.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A control for an appliance comprising:

an electrical switch having contacts for controlling the appliance;

a shaft communicating at a proximal end with the electrical switch to actuate the electrical switch to reversibly open and close the contacts with rotation of the shaft about an axis, the shaft having a light passageway at a distal end;

an LED positioned within the shaft and attached to rotate therewith and aligned with the light passageway to project a beam of light substantially perpendicular to the axis therefrom.

2. The control of claim 1 further including second contacts communicating with the LED to conduct electricity to the LED with rotation of the shaft.

3. The control of claim 2 wherein the electrical switch includes terminals receiving line voltage and wherein the second contacts communicate with corresponding contact surfaces connected to the line voltage.

4. The control of claim 3 further including at least one electrical resistor providing a voltage dropping of the line voltage to control a current passing through the LED.

5. The control of claim 3 wherein the light passageway includes a light pipe of transparent material conducting light from the LED by internal reflection.

6. The control of claim 1 further including knob engaging the distal end of the shaft in the knob having a second light passageway aligned with the light passageway of the distal end of the shaft to communicate light from the LED to an edge of the knob to illuminate indicia indicating cycle information.

7. The control of claim 6 wherein the second light passageway is a lens.

8. The control of claim 7 wherein the control is adapted to be mounted on a panel with the electrical switch on one side of the panel and the shaft passing through a hole in the panel and wherein the second light passageway of the knob directs light at the panel holding the indicia.

9. The control of claim 1 wherein the shaft further includes a portion of a mechanical detent cooperating with a corresponding portion of the mechanical detent held by a housing containing the electrical switch and supporting for rotation the shaft, the mechanical detent providing rotational detent positions as the shaft is turned.

10. The control of claim 1 further including second contacts communicating with the LED to conduct electricity to the LED with rotation of the shaft;

wherein the electrical switch includes terminals receiving line voltage and wherein the second contacts communicate with corresponding contact surfaces connected to the line voltage;

further including at least one electrical resistor providing a voltage dropping of the line voltage to control a current passing through the LED;

wherein the light passageway includes a light pipe of transparent material conducting light from the LED by internal reflection; and wherein the LED communicates with the light pipe at a fracture plane of the shaft defining a plane of fracture when the shaft is impacted from a side so that in an event of fracturing of the shaft the LED and connections of the LED to line voltage remains recessed in a portion of the shaft beneath the fracture plane remaining attached to the electrical switch.

11. A control for an appliance comprising:

an electrical switch having contacts for controlling the appliance;

a shaft communicating at a proximal end with the electrical switch to actuate the electrical switch with rotation of the shaft about an axis, the shaft having a light passageway at a distal end;

an LED positioned within the shaft and aligned with the light passageway to project a beam of light substantially perpendicular to the axis therefrom;

further including second contacts communicating with the LED to conduct electricity to the LED with rotation of the shaft;

wherein the electrical switch includes terminals receiving line voltage and wherein the second contacts communicate with corresponding contact surfaces connected to the line voltage, wherein the LED communicates with the second contacts by means of electrical conductors preferentially separating into distal and proximal portions at a separation plane crossing the axis and displaced with respect to a fracture plane of the shaft so that in an event of fracturing of the shaft the distal portion remains recessed within the shaft beneath the fracture plane.

12. The control of claim 11 wherein the distal and proximal portions of the electrical conductors are joined by a releasable electrical connector at the separation plane.

13. The control of claim 11 wherein the distal and proximal portions of the electrical conductors are joined by a spring and abutting contact at the separation plane.

14. The control of claim 13 wherein the distal portion is a spring communicating between an abutting contact portion and a trace on a printed circuit board providing a contact carrier.

15. The control of claim 11 wherein the fracture plane of the shaft is defined by a stress-concentrating feature in the shaft.

16. An appliance having a console panel including at least one control providing a manually operable control comprising:

a housing sitting behind the panel and holding an electrical switch having contacts for controlling the washing machine;

a shaft rotatably extending through the housing and the panel, the shaft communicating at a proximal end with the electrical switch to actuate the electrical switch to reversibly open and close the contacts with rotation of the shaft about an axis, the shaft having a light passageway at a distal end on an opposite side of the panel as the electrical switch; and an LED positioned within the shaft at the distal end aligned with the light passageway to project a beam of light substantially perpendicular to the axis therefrom and attached to rotate with rotation of the shaft.

* * * * *